US006705141B1

(12) United States Patent
Jacob et al.

(10) Patent No.: US 6,705,141 B1
(45) Date of Patent: Mar. 16, 2004

(54) COMBINED MECHANICAL AND ELECTRONIC KEY, IN PARTICULAR FOR THE LOCKS OF MOTOR VEHICLES

(75) Inventors: Dirk Jacob, Heiligenhaus (DE); Ulrich Müller, Velbert (DE); Jeffrey D. Plate, Brown Deer, WI (US)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/168,362

(22) PCT Filed: Nov. 22, 2000

(86) PCT No.: PCT/EP00/11619

§ 371 (c)(1),
(2), (4) Date: Jun. 21, 2002

(87) PCT Pub. No.: WO01/48339

PCT Pub. Date: Jul. 5, 2001

(30) Foreign Application Priority Data

Dec. 24, 1999 (DE) ..... 199 62 975

(51) Int. Cl.[7] ..... E05B 19/04
(52) U.S. Cl. ..... 70/408; 70/278.3; 70/456 R
(58) Field of Search ..... 70/278.1–278.3, 70/408, 456 R, 395, 399

(56) References Cited

U.S. PATENT DOCUMENTS

| | | | | | |
|---|---|---|---|---|---|
| 4,524,594 | A | * | 6/1985 | Bascou | 70/456 R |
| 4,888,970 | A | * | 12/1989 | Kinzler et al. | 70/456 R |
| 4,941,569 | A | * | 7/1990 | Lindmayer et al. | 70/456 R |
| 5,819,568 | A | * | 10/1998 | Christie et al. | 70/395 |
| 5,832,761 | A | * | 11/1998 | Chen | 70/395 |
| 6,164,101 | A | * | 12/2000 | Kito et al. | 70/278.3 |
| 6,367,299 | B1 | * | 4/2002 | Janssen et al. | 70/278.3 |
| 6,427,504 | B1 | * | 8/2002 | Janssen et al. | 70/278.3 |
| 6,499,326 | B1 | * | 12/2002 | Heussner | 70/399 |

FOREIGN PATENT DOCUMENTS

| | | | | |
|---|---|---|---|---|
| DE | 3902537 | * | 8/1990 | |
| DE | 4226579 | | 2/1994 | |
| EP | 0985788 | | 3/2000 | |
| FR | 1425414 | * | 12/1965 | 70/408 |
| GB | 2039321 | * | 8/1980 | 70/408 |
| GB | 2080386 | * | 2/1982 | |
| IT | 597276 | * | 8/1959 | 70/456 R |
| WO | 9717863 | | 5/1997 | |

* cited by examiner

*Primary Examiner*—Suzanne Dino Barrett
(74) *Attorney, Agent, or Firm*—Friedrich Kueffner

(57) ABSTRACT

The invention relates to a combined mechanical and key comprising a key housing for electronic components and an L-shape flat key (30). Said flat key consists of a bearing limb (31) which enables the key to pivot into a storage position and a shank (32) which mechanically operates the lock. The shank (32) of the flat key (30) can be displaced between an inoperative position, retracted into the key housing and an operative position, in which it projects out of the hosing. A push-button preferably also acts as the pivoting axis for the flat key (30). The push-button and the housing have profiled sections and the bearing limb has co-operating profiled sections (37, 38, 39), to subject the flat key (30) to a force in the operative position and to lock the key in one of its positions. The invention aims to produce a simple, cost-effective key. To this end, the flat key is configured as a planar plate (34) with an L-shaped outline, the shank (32) sharing the same plane as the bearing limb. The bearing limb (31) has an opening (35) in the plate for receiving, in a rotationally fixed manner, an insert (36) that has the co-operating profiled section (37 to 39).

8 Claims, 5 Drawing Sheets

COMBINED MECHANICAL AND ELECTRONIC KEY, IN PARTICULAR FOR THE LOCKS OF MOTOR VEHICLES

The invention pertains to a combination key of the type indicated in the introductory clause of claim 1. A key of this type makes it possible to actuate locks directly in a mechanical manner but also, either alternatively or supplementally, to actuate them electronically, e.g., to actuate the particular lock in question or other locks from a remote location. The key container itself represents the means by which the key is actuated both mechanically and electrically. For the purpose of electronic actuation, therefore, the key container has actuating points on its outside surface in the form of, for example, electrical push buttons or resilient membranes, which act on electrical switches or the like provided inside the container. The flat mechanical key has the shape of an "L" and is supported by one of the sidepieces of the L on the forward end of the container with freedom to pivot, for which reason this sidepiece is referred to below as the "support sidepiece". When the flat key is in its home position, the other sidepiece of the L, which forms the shaft of the key, is inside the container, into which it has been pivoted. This sidepiece of the L is referred to in the following as the "shaft sidepiece". The shaft sidepiece of the flat key can be pivoted out of the container and into the working position. To hold the flat key securely in place, it is recommended that it be latched in the key container when in either of its two positions.

In the case of the known key of the type indicated in the introductory clause of claim 1 (EP 0 267 429), the L-shaped flat key with its two sidepieces consists of two parts; it has a top piece in the form of a support ring with a tangential projection, into which the end of a blade can be inserted and to which the blade is detachably connected. The inserted connecting piece of the blade must be secured by a screw or a rivet after insertion. This is laborious and time-consuming. The L-sidepiece forming the shaft sidepiece of the known flat key comprises the support ring, the projection, and the inserted blade. The shaft sidepiece is therefore formed out of two parts. The transition area between the inserted blade and the projection on the support ring is subject to breakage. To prevent it from breaking, the material in the projection of the ring enclosing the receiving slot for the blade must be made as thick as possible, which leads in the direction away from the goal, which is to obtain a space-saving key.

In another known key (DE 39 02 537 C2), a mechanical push button is provided in the area of the pivot axis of the flat key; this button is spring-supported in both the axial and radial directions. The push button serves as a pivot axis for the flat key. The double spring support of the push button has two tasks to perform for the flat key. One of these tasks is to spring-load the flat key so as to pivot it out of its home position and into its working position. The other task is to latch the key as securely as possible in either one of its two pivot positions. For this purpose, the push button requires suitable contours, and the flat key requires suitable counter contours. Although the flat key is designed with the shape of an "L", the support sidepiece must, because it carries the counter profiles, be of considerable thickness, and it is therefore prefabricated separately as a support body with a rectangular profile. So that the considerable thickness of the support body can be utilized, the shaft sidepiece is located on a plane parallel to the pivot axis of the flat key. This means in turn that the key container must has a corresponding thickness. The support body of the flat key serving to hold the mechanical push button has a slot for the subsequent attachment of the key shaft, which is fabricated separately. The key shaft is inserted into a slot in the support body and secured in place there by a pin or the like. This process is time-consuming and expensive.

There are also combination keys (DE 22 26 385 A and DE 38 42 790 C1), which, although they comprise a flat, L-shaped key, nevertheless do not have a push button in the area of the axis. An immovable bearing pin serves as the pivot axis. Because no counter profile is required for a push button, the support sidepiece of the flat profile serving as a support for the pivoting movement can be flat. The flat key is designed as a flat plate, in-which the flat profile of the shaft sidepiece also lies. This key housing can be built flatter, but there is no spring-loading to move the shaft sidepiece out of a rest position, recessed in the key container, into the outward-pivoted working position. This makes the key difficult to manipulate. In addition, there is no space-saving way to latch the flat key in these two positions in the container. The inability to secure the flat key in its pivoted positions leads to problems both when the key is carried in the user's pocket and also when it is used, e.g., when the key housing is turned to operate the lock.

When it is desired to fasten a component to a sheet-metal section with a screw, it is known that, to obtain the required depth for the screwing-in of the screw, the depth of the female thread in the sheet-metal section can be increased by an adapter or a riveted insert (U. Richter, R. v. Voss, and F. Kozer: *Bauelemente der Feinmechanik* [*Structural Elements in Precision Mechanics*], Berlin, Verlag Technik, 1954, p. 137). This way of providing female threads in sheet-metal sections is incompatible with the concept of a flat key. The publication cited does not provide any suggestions concerning the design of flat, L-shaped keys.

The invention is based on the task of developing a reliable, space-saving key of the type indicated in the introductory clause of claim 1, which can be produced more easily and at lower cost. This is accomplished according to the invention by means of the measures listed in the characterizing clause of claim 1, to which the following particular meaning belongs:

In the invention, the key with the two sidepieces of its L shape is designed as a single unit in the form of a flat plate. The L-shaped flat key can be stamped out of plate material. As a result of this one-piece design, a strong, unbreakable transition area is obtained between the support sidepiece and the shaft sidepiece. In spite of the flat design of this L-shaped key, the mechanical push button in the key container can still be installed in the area of the support sidepiece. This is possible because the counter profiles required in and of themselves for the push button are left to an insert, which is mounted nonrotatably in an opening in the plate of the bearing sidepiece The insert serves to provide both pivoting support and, advisably, axial guidance for the push button; the insert also serves to accept the spring for the push button. As a result, the design of the key container is simplified as well. In spite of the one-piece, inexpensive L-shape of the flat key, the key can still be latched securely in both its home and working positions via the push button. In addition, when, in the home position, the latching function is deactivated by pushing the push button, the key is pivoted automatically from its home position to the working position by the elastic force acting on it by way of the driver surfaces provided on the push button and on the insert.

Additional measures and advantages of the invention can be derived from the subclaims, from the following description, and from the drawings. An exemplary embodiment of the invention is illustrated schematically in the drawings:

Figures 1, 2:
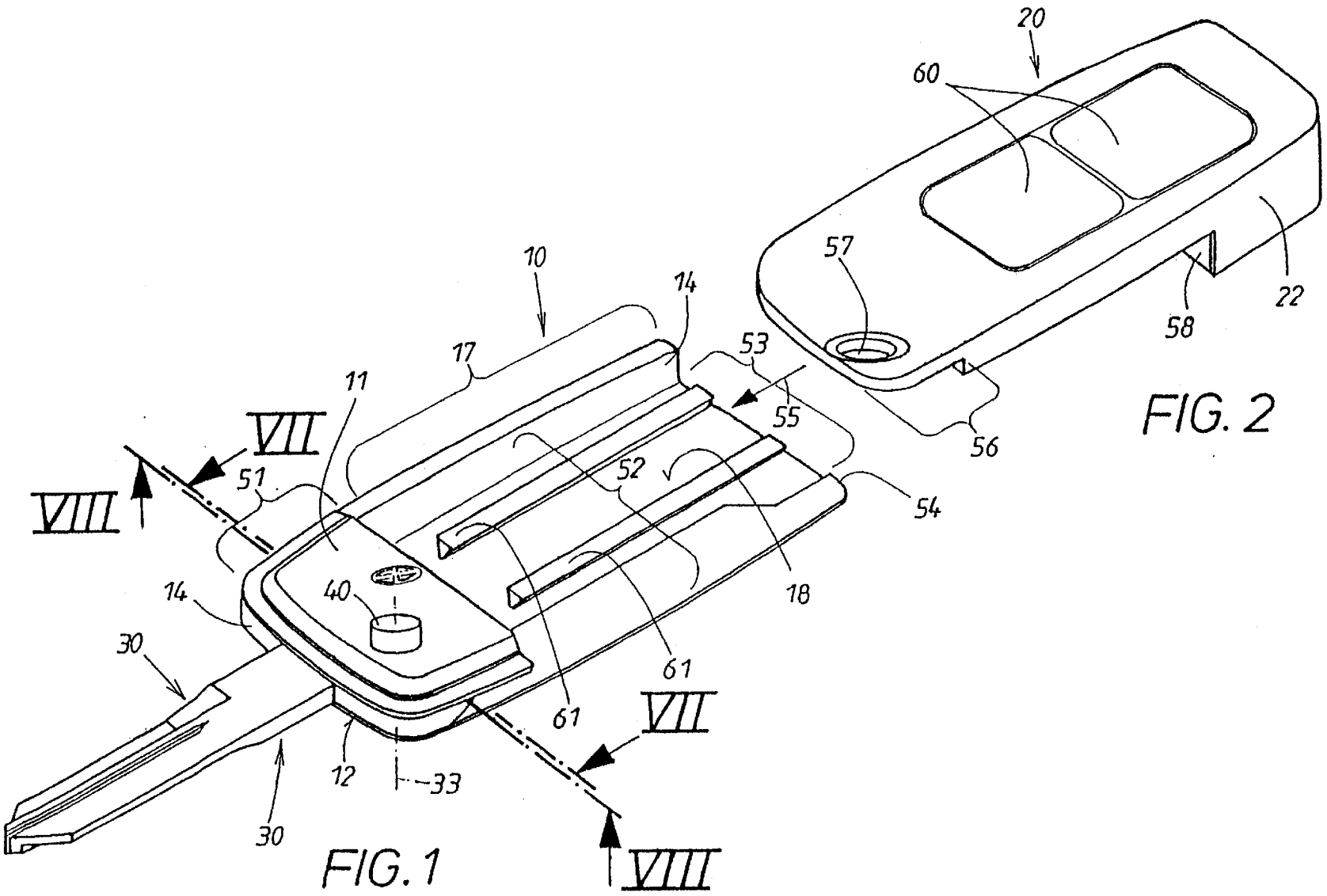
FIG. 1 shows a perspective view of the key container, from which mechanical flat key projects.
FIG. 2 shows another perspective view, this time of a plug-in unit belonging to the flat key of FIG. 1, consisting of an electronic capsule enclosing the electronic components.

The combination key according to the invention allows both the mechanical and the electronic actuation of a lock (not shown). It consists of two parts 10, 20, each prefabricated separately, which are then inserted into each other. The one part 10 comprises the mechanical closing means and consists of a key container 10, the components of which can be seen most easily in the exploded diagram of FIG. 4. The other part 20 is a plug-in unit, to be described in greater detail below, which holds in its interior the electronic components 40, indicated in cross section in FIG. 9.

Figure 4:
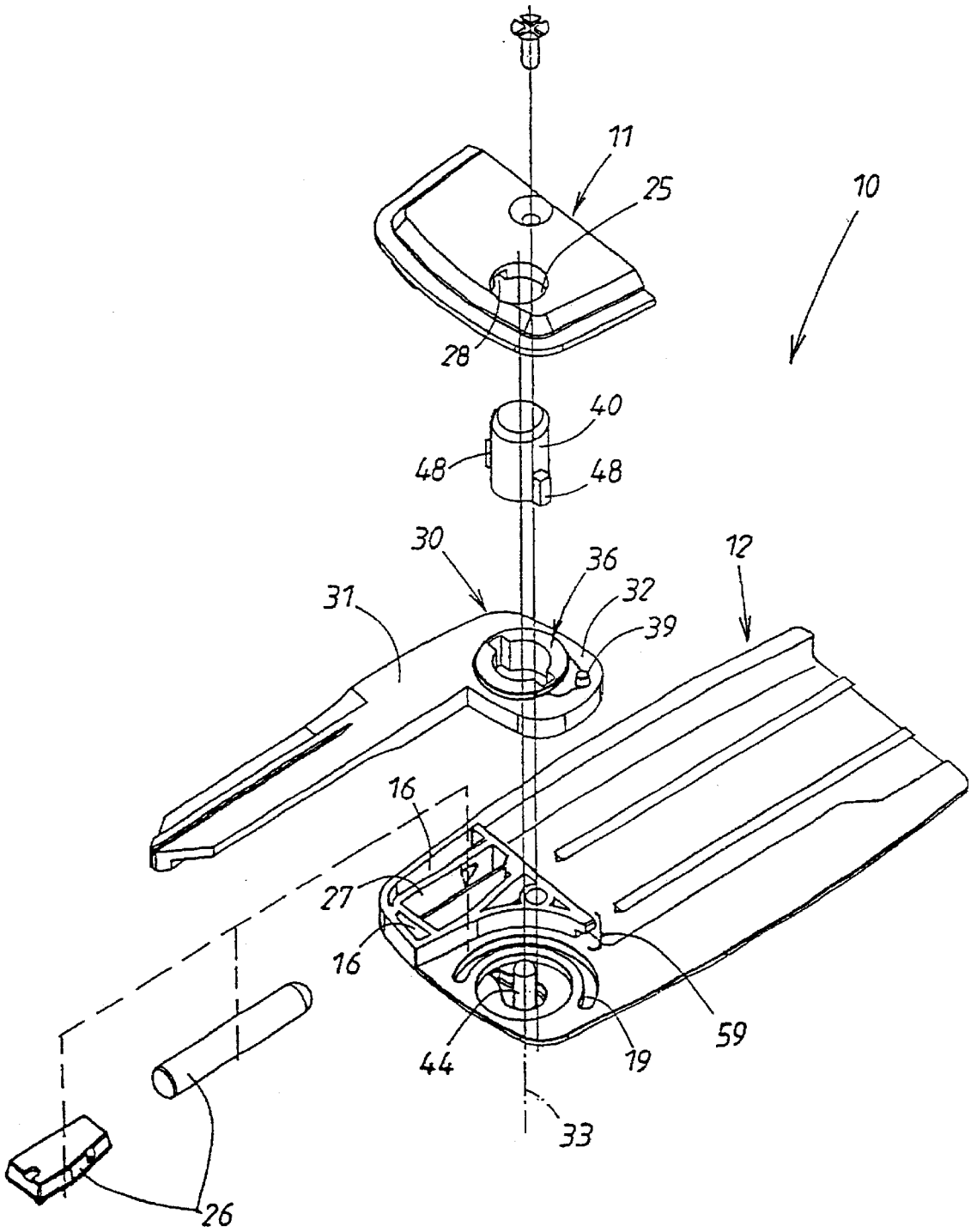
FIG. 4 shows an exploded view of some of the essential parts of the key container shown in FIG. 1, along with the mechanical flat key, before the parts have been assembled.
Figure 7:
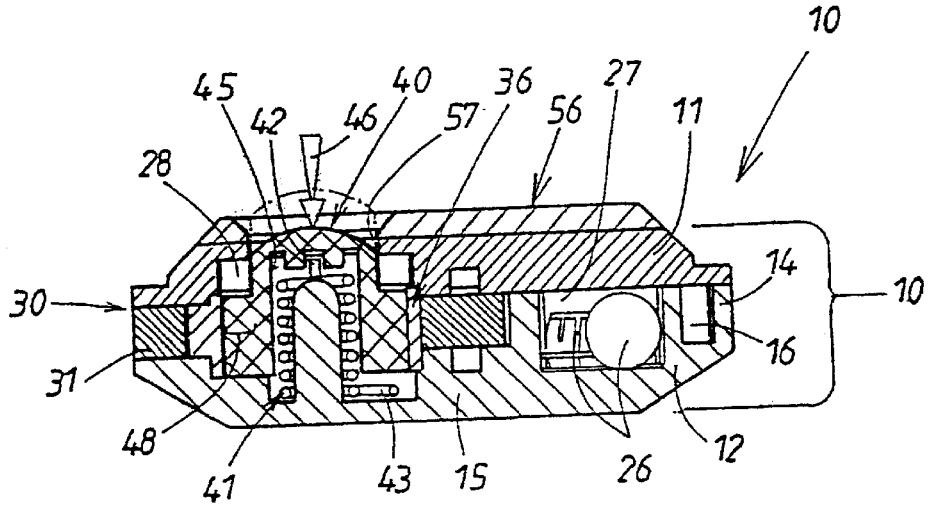
FIG. 7 shows a cross section through the assembled key container of FIG. 1 along the cross-sectional line VII—VII shown there, where the push button is seen in its pushed-in position.
Figure 8:
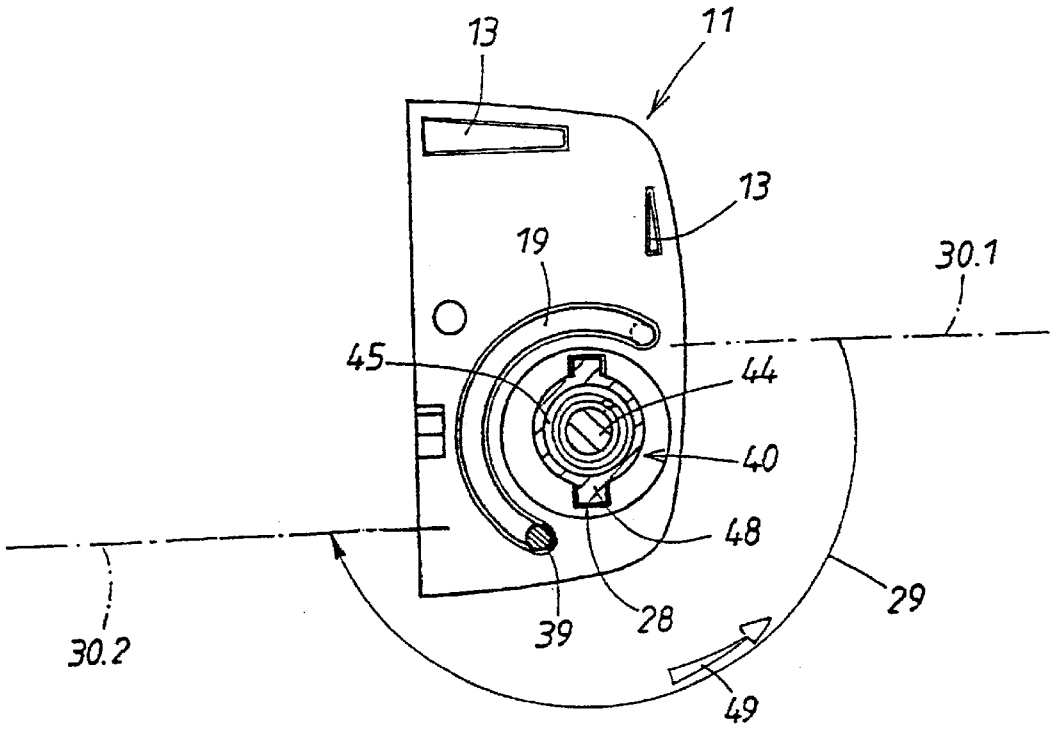
FIG. 8 shows an axial cross section through the key container shown in FIG. 1 along the cross-sectional line VIII—VIII shown there.

As can be seen on the basis of FIGS. 1 and 4, the mechanical part comprises, first, a two-shell key container 10. Whereas the upper shell 11, as can be seen in FIGS. 7 and 8, is designed as a flat plate with connecting projections 13 at various points on its inside surface, the lower shell 12 comprises side walls 14 and a bottom part 15. Connecting sockets 16 for the previously mentioned connecting projections 13 on the upper shell 11 are located at various points in the side walls 14. The upper shell 11 extends only over the front end of the key container 10 and has at the rear an open area 17, which creates an empty space accessible from the outside and leading toward the interior 18 of the shell. This is important for the insertion and removal of the plug-in unit 20 to be described in greater detail below.

Figure 5:
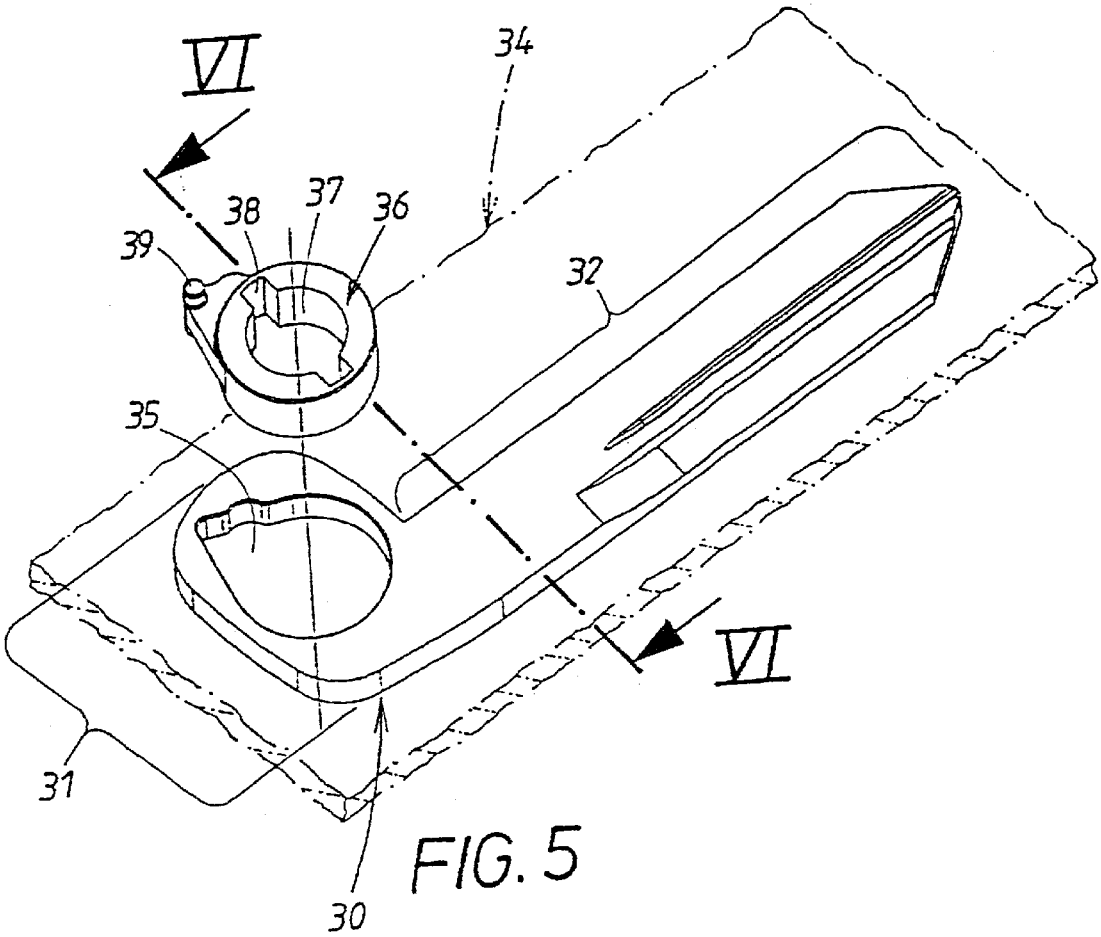
FIG. 5 shows an exploded view of the two components of the mechanical flat key before they are combined.

The key container 10 also includes, as FIG. 4 shows, a mechanical flat key 30, which is installed with freedom of movement, so that it can be moved from a recessed, home position in the container 10 (not shown) into a working position, projecting from the container, as shown in FIGS. 1–4. The flat key 30 is made of metal. Although other types of movement could also be imagined, this flat key 30 is free to pivot around the pivot axis 33, indicated in broken line in FIGS. 1, 3, and 4. The flat key 30 is made as a stamping from a flat plate 34, illustrated in broken line in FIG. 4; the stamping has an L-shaped outline with two sidepieces 31, 32. One of the sidepieces of the L is short and serves to support the flat key 30 at the front end of the key container so that the key can pivot and is therefore referred to in short below as the "support sidepiece". The other sidepiece 32 of the L comprises the actual flat profile of the key shaft, for which reason it is referred to in the following as the "shaft sidepiece". These two sidepieces 31, 32 therefore lie in a common plane, determined by the previously mentioned plate 34; in the final assembled state of the key container 10, this plane is perpendicular to the pivot axis 33. As can be seen in FIG. 5, the support sidepiece 31 is provided with a noncircular plate opening 35, which serves to hold a separate insert 36.

The push button 40 is spring-loaded both in the axial and in the radial direction and has profiles 19, 48, 28 designed to be in agreement with those of the container 10. The insert 36 consists of relatively resilient material, preferably plastic, and has a special counter profile 37, 38, 39 for a push button 40, which determines the position of the pivot axis 33. The spring action is exerted by a combination compression-torsion spring 41, which, as can be seen in FIG. 7, is held in an axial bore 45 in the push button 40. The spring 41 is attached nonrotatably by its one end 42 to the push button 40, whereas the other end 43 of the spring is attached to the lower shell 12 of the container 10. The spring 41 is helical in design. During the assembly process, a mandrel 44, seated on the inside surface of the bottom of the lower shell 12, projects into the interior of the spiral and also into the insert 36.

Figure 6:
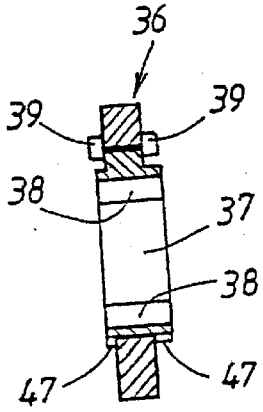
FIG. 6 shows a cross section through the component of FIG. 5 along the cross-sectional line VI—VI shown there.

According to FIG. 5, the flat key 30 and its plate opening 35 are first produced by stamping, and then the insert 36 is inserted vertically into the plate opening 35. After insertion, the insert projects beyond the two flat surfaces of the flat key, as FIGS. 4 and 7 show. In addition, the insert also has cylindrical projections 47, shown in FIG. 6, and stop pins 39, extending from each of the two flat sides and projecting into ring-shaped groove segments 19 in the two shells 11 and 12, as can be seen in FIG. 8. When the stop pin 39 is in the position shown in solid line in FIG. 8, the key is in the previously mentioned working position, after it has been pivoted out of the container 10. Then the previously described shaft sidepiece 32 of the flat key 30 extends in the direction of the auxiliary line 30.1 indicated in broken line in FIG. 8, which characterizes the working position of the flat key 30 illustrated in the other figures. In this working position 30.1, the flat key is latched by the push button 40. Then driver wings 48, arranged diametrically in the present case on the push button 40, engage in associated radial grooves 28 in the inside surface of the upper shell 11 and thus secure the flat key 30 in its outward-pivoted position.

Axial grooves 48 in the insert 36 serve as counter profiles for the driver wings 48; these grooves allow an inward-pushing movement in the direction of the force arrow. 46 shown in FIG. 7. This inward movement 46, which has been completed in FIG. 7, pushes the push button 40 into its lowered position, as a result of which the driver wings 48 become disengaged from the radial grooves 28. The inward movement 46 takes place against the axial force of the spring 41. The latching of the working position 30.1 is then released. The flat key can then be swung back into its home position in the housing in the direction of the motion arrow 29 of FIG. 8 against the torsional force of the spring 41, illustrated by the force arrow 49 in FIG. 8. Then the shaft sidepiece 32 of the flat key 30 lies on the broken line indicated by the number 30.2, as seen in FIG. 8. In this home position 30.2, the shaft sidepiece 32 has disappeared in the lateral gap 24, which can be seen in FIG. 3, of the overall housing 50, to be described in greater detail below, which is formed out of the key container 10 and the plug-in unit 20, which has been inserted into the container. Then the driver wings 48 are again in axial alignment with the radial grooves 28 in the housing; they snap into the grooves under the restoring force of the spring 41 and thus also latch the flat key in this home position 30.2 in the key container 10.

The push button 40 also serves as a pivot bearing for the pivoting movement 29. For this purpose, a bearing bore 25 is provided in the upper shell 11 of the container 10, as can be seen in FIG. 4. This bore is in axial alignment with an axial bore 37 in the insert 36 shown in FIGS. 5 and 6 and with the previously mentioned mandrel 44 on the lower shell 12. The push button 40 determines the pivot axis 33 of the flat key 30. The stop pin 39 on the insert on one side and the ring-shaped groove segment 19 assigned to it on the housing side can also take over rotational guide functions during the pivoting movement 29. In addition, rotational stops can also be realized by the outline profile of the key 30 on the one side and inside surfaces on the two shells 11, 12 on other.

Instead of prefabricating the insert 36, it would also be possible to postfabricate the insert 36 by an injection-molding technique. For this purpose, the described flat key 30 is introduced into an injection mold, in which the insert 36 is then formed in the plate opening 35 by casting. The counter profiling 37, 38, 39, 47 mentioned above is then present again in the same form.

In many applications, a so-called transponder 26 is also desirable in the case of the above-mentioned combination key for electronic actuation. This transponder 26 is intended to individualize the combination key electronically right from the start. When the key is inserted into the associated lock, a communications process take place between the transponder 26 and the lock; if it is found that the lock and the key belong together, the lock functions are initiated immediately. For this reason, transponders 26 of this type are installed in the forward area of the key container 10 in the invention. For this purpose, the lower shell 12 has a chamber 27, into which the transponder(s) 26 can be cemented. Because an electronic power supply is not required for the transponder 26, the final assembled key container 10 of FIG. 1 does not need to be separated into its shells 11, 12 so that the battery can be replaced, etc. The transponders 26 are therefore protected permanently in their chamber 27. This also applies to the previously mentioned additional electronic components 21, which form an internal part of the previously mentioned detachable plug-in unit 20 of the overall housing 50.

Figure 9:
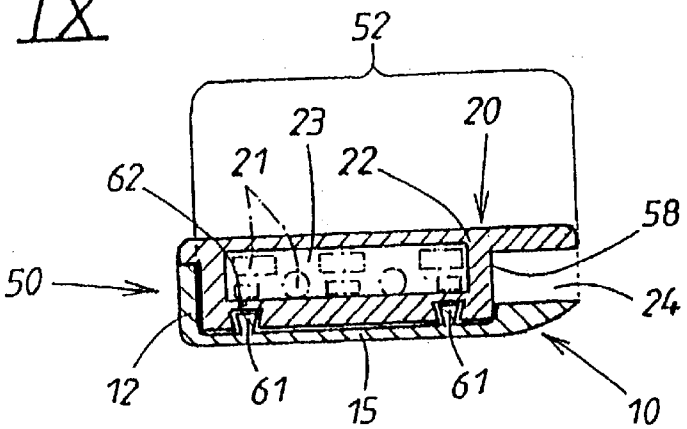
FIG. 9 shows a cross section through the combination housing shown in FIG. 3 along the cross-sectional line IX—IX shown there.

As can best be seen in FIG. 9, a housing-like capsule 22, in the interior 23 of which the components 21 are mounted and thus closed off on all sides from the outside, belongs to the plug-in unit 20. The wiring of the components and possibly the electrical interference can be provided in the interior 23 of the capsule. This structural unit 21, 22, which can be plugged into the key container 10, is prefabricated as a complete unit and is called the "electrocapsule" in the following. For assembly purposes, the key container 10 is shaped to accommodate it as follows:

The previously mentioned open area 17 of the key container 10 is produced simply by allowing the upper shell 11, as seen in FIG. 1, to cover only the forward section 51 of the key container 10. As a result, an open area accessible from the outside and leading to the interior 18 of the shell is created. This open area 17 has not only an upper opening 52 facing upward but also a side opening 53, accessible from the rear 54. This side opening arises because not only the rear section of the upper shell 11 is missing but also, as FIG. 1 shows, the side wall 14 of the lower shell 12 has been omitted at the rear 54 of the container 10. The electrocapsule 20 is pushed through this side opening 53 into the open area 17 of the key container 10 in the direction of the motion arrow 55 of FIG. 1. In its plugged-in position according to FIG. 3, the electrocapsule 20 seals off the upper opening 52. The plug-in movement 55 is on a plane parallel to the above-mentioned pivoting movement 29. The following guide means 61, 62 are provided to guide the insertion and sliding-in movement 55 of the electrocapsule 20.

Figure 3:
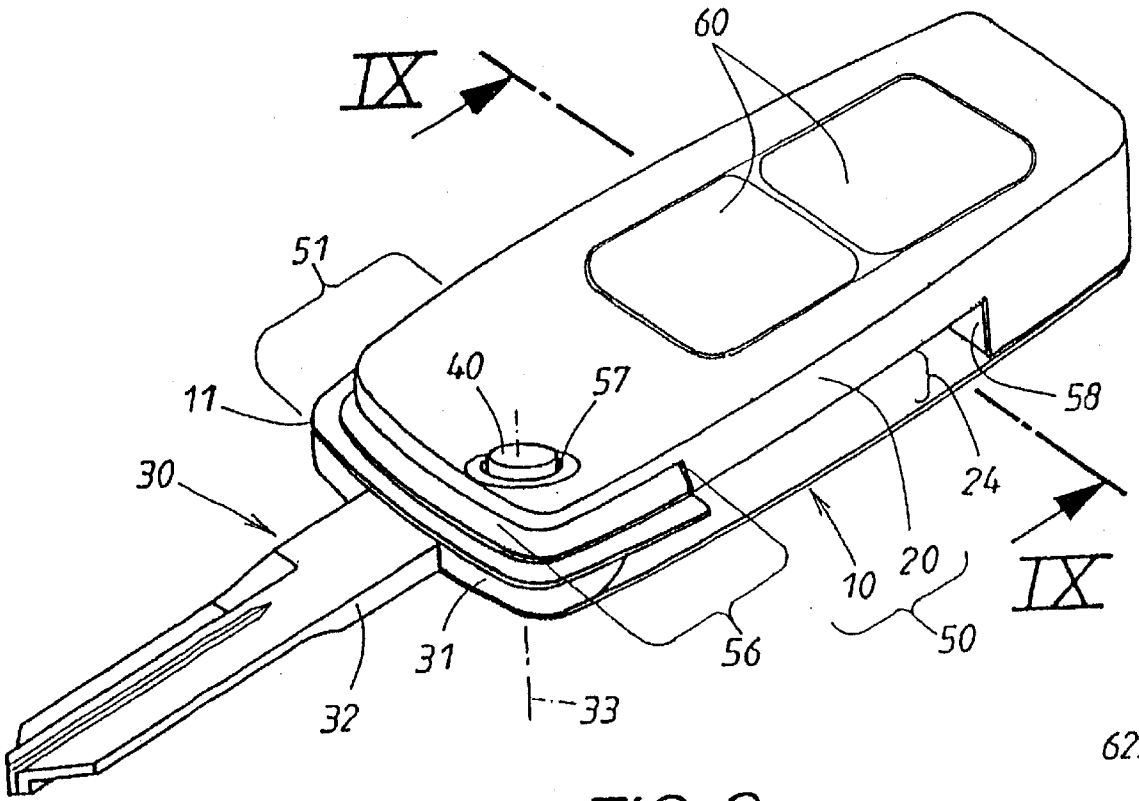
FIG. 3 shows a combination housing, assembled from the key container of FIG. 1 and the plug-in unit of FIG. 2, which is used to manipulate the key during the mechanical and electronic actuating processes.

On the interior surface of the bottom 15 of the lower shell 12, there are two parallel guide strips 61, which extend toward the side opening 53. They are undercut and have preferably a dovetail profile. To these strips are assigned complementary guide grooves 62 in the bottom surface of the housing of the electrocapsule 20. The engagement between these guide means 61, 62 can be seen in the cross section of FIG. 9. One of the long sides of the capsule housing 22 according to FIG. 9 has a step at 58, so that, together with a corresponding step 59 in the lower shell 12 according to FIG. 4, the lateral gap 24 for the shaft sidepiece 32 of the flat key 30 is created when the capsule is inserted. In the inserted position according to FIGS. 3 and 9, the external surfaces of the electrocapsule 20 which remain visible on the one side and the external surfaces of the key container 10 which remain visible on the other form a flush transition with each other. The two parts 10, 20 form then the previously mentioned combination housing 50; during the manipulation of the key, the two parts are gripped jointly by the hand. The combination of the two is therefore called the "combination housing". This applies both to the mechanical actuation of the associated lock, when the outward-pivoted shaft sidepiece 32 is turned by means of the combination housing 50, and also to the electronic actuation. For this purpose, actuating points 60 are provided in the common combination housing 50 on the still-visible outside surface of the electrocapsule 20. These can take the form of push button switches or membrane actuating points. These actuation sites can be provided with additional membrane-like covers in the area of the previously mentioned push button 40, to which the following special meaning belongs:

The insertion position of the electrocapsule 20 in the key container 10 shown in FIGS. 3 and 9 is not only limited by stop means but also secured by latching means. This latching function can also be taken over advantageously by the push button 40. For this purpose, the electrocapsule 20, according to FIG. 2, is extended at the front by a tab 56, which, when in the inserted position of FIG. 3, covers the remaining forward section 51 of the upper shell 11 of the key container 10. The tab 56 has an opening 57, into which the axially spring-loaded push button 40 snaps when the electrocapsule 20 according to FIG. 3 is plugged into position. As a result, it is ensured that the key container and the electrocapsule 20 will be held securely together. The opening 57 passes through the tab 56, for which reason, after the parts have engaged as shown in FIG. 3, a longitudinal piece of the push button 40 sufficient for actuation projects out from the tab 56. To disassemble the combination housing 50 into its component parts 10, 20, the push button 40, as shown in FIG. 7, is pushed in the direction of arrow 46 until it disengages from the opening 57 in the tab 56.

The push button 40 can be covered by a membrane in the area of the tab 56, which membrane functions in the same way as for the actuating points 61. These membranes of the actuating points 61 can be combined with the previously mentioned membrane in the area of the push button.

List of Reference Numbers

10 first key part, key container
11 upper shell of 10
12 lower shell of 10
13 connecting projection on 11
14 side wall of 12
15 bottom of 12

16 connecting receptacle in 12
17 open area of 11, free space in 18
18 interior of shell
19 profile in 11, 12 for 39, ring-shaped segment
20 second part of key, plug-in unit, electrocapsule
21 electronic component
22 housing-like capsule for 21
23 interior of capsule for 22 in 21
24 lateral gap in 50 for 32 (FIGS. 3, 9)
25 bearing bore in 11 for 40 (FIG. 4)
26 transponder
27 recess in 11 for 26 (FIG. 4)
28 profile in 11 for 48 of 40, radial groove (FIG. 7)
29 pivoting movement arrow for 30 (FIG. 8)
30 mechanical flat key for 10, stamping
30.1 working position of 32 (FIG. 8)
30.2 home position of 32 (FIG. 8)
31 first L-sidepiece of 30, support sidepiece
32 second L-sidepiece of 30, shaft sidepiece
33 pivot axis for 30
34 flat plate for 30
35 plate opening
36 insert in 35
37 counter profile in 36, axial bore (FIGS. 5, 6)
38 counter profile of 36, axial groove in 36 for 48 (FIGS. 5, 8)
39 counter profile of 36, guide or stop pin (FIGS. 5, 6)
40 push button
41 compression-torsion spring for 40
42 first end of spring 41 (FIG. 7)
43 second end of spring 41 (FIG. 7)
44 mandrel on 12 for 41 (FIG. 4)
45 axial bore in 40 for 41
46 arrow of the pushing-in movement of 40 (FIG. 7)
47 counter profile on 36, cylindrical shoulder on 36 (FIG. 5)
48 profile, driver wing on 40
49 arrow of the outward-pivoting force of 41 for 30 (FIG. 8)
50 overall housing consisting of 10, 20, combination housing
51 forward section of 10
52 upper opening of 10 at 17 (FIG. 1)
53 side opening in 11 (FIG. 1)
54 rear of 10
55 arrow of the insertion movement of 20 into 10 (FIG. 1)
56 tab on 20 (FIG. 2)
57 opening in 56 for 40 (FIG. 2)
58 inside step on 22 for 24 (FIGS. 2, 9)
59 step on 12 for 24 (FIG. 4)
60 actuating point on 20 (FIG. 1)
61 guide means on 12, guide strip
62 guide means on 20, guide groove

What is claimed is:

1. A combination mechanical and electronic key, comprising:

a common key container (10) to be manipulated when actuating the lock, containing both electronic components (21) for electronic actuation of the lock and an L-shaped flat key (30) for mechanical actuation of the lock;

one sidepiece of the L-shaped flat key (30), is a support sidepiece (31), that is pivotably supported (33) at a forward end (51) of the container (10);

another sidepiece of the L-shaped key, which forms a flat-profiled key shaft, is a shaft sidepiece (32) that has freedom to move from a home position (30.2), in which the shaft sidepiece is recessed inside the container (10), to an outward-pivoted working position (30.1);

a spring-loading member (41) acting in axial and radial directions; and a push button (40) arranged to determine a pivot axis (33) of the flat key (30) in the key container (10);

the push button (40) and the container (10) have profiles (48, 28) and the support sidepiece (31) has counter profiles (37, 38, 39, 47), by means of which the flat key (30) is subjected to a load directed toward the working position (30.1) and is latched in at least one of the home position and the work position (30.1, 30.2); and the shaft sidepiece (32) is located on a common plane with the support sidepiece (31), which works together with the push button (44), the plane being perpendicular to the pivot axis (33);

the L-shaped flat key (30) with the two sidepieces (31, 32) is as a one-piece flat plate;

the support sidepiece (31) has a noncircular opening (35); and the plate opening (35) serves to accept a nonrotatable insert (36), which has a counter profile (37, 38, 39, 47), the L-shaped flat key (30) and the noncircular plate opening (35) being stamped out of plate material (34) and thus form a stamping.

2. The key according to claim 1, wherein the insert (36) along with the counter profile (37, 38, 39, 47) can be produced as a prefabricated part and has a noncircular outline; and the insert (36) is inserted into the plate opening (35) in the plate, where it is held in place in at least one of a friction-locking and a form-locking manner.

3. The key according to claim 1, wherein the flat key (30) is formed out of a relatively metallic material, whereas the insert (36) consists of relatively resilient material.

4. The key according to claim 1, wherein at least a certain part of the insert (36) projects beyond at least one of the two plate surfaces of the flat key (30).

5. The key according to claim 1, wherein the insert (36) is formed in an area of the plate opening (35) by injection molding and is bonded by the injection-molding to the flat key (30).

6. The key according to claim 1, wherein the counter profile of the insert (36) has at least one of an axially projecting rotational stop and a rotational guide element (39); and, after assembly, the rotational stop and/or rotational guide element projects into a ring-shaped segment (19) on an inside surface of the key housing (10).

7. The key according to claim 1, wherein the counter profile of the insert (36) comprises an axial bore (37) with at least one axial groove (38) projecting radially from the axial bore, in which groove at least one set-off driver wing (48) of the push button (40) engages at least one of during certain periods of time and over a certain region.

8. The key according to claim 3, wherein the insert is made of plastic.

* * * * *